US006062448A

United States Patent [19]

Balodis

[11] Patent Number: 6,062,448

[45] Date of Patent: May 16, 2000

[54] CARRYING DEVICE FOR A CLOSED UMBRELLA AND METHOD OF USING SUCH DEVICE

[76] Inventor: Brian Balodis, 343 E. 30th St., New York, N.Y. 10016

[21] Appl. No.: 08/406,108

[22] Filed: Mar. 17, 1995

Related U.S. Application Data

[63] Continuation-in-part of application No. 07/934,289, Sep. 24, 1992, abandoned, which is a continuation of application No. 07/718,063, Jun. 20, 1991, abandoned.

[51] Int. Cl.[7] ..... A45F 3/14

[52] U.S. Cl. ..... 224/257; 224/250; 224/258; 224/915

[58] Field of Search ..... 224/257, 258, 224/915, 150, 264, 917, 250; 294/157; 24/300, 301

[56] References Cited

U.S. PATENT DOCUMENTS

| | | | |
|---|---|---|---|
| D. 283,758 | 5/1986 | Stewart et al. . | |
| 486,135 | 11/1892 | Stockdale et al. . | |
| 608,472 | 8/1898 | McCormack . | |
| 631,172 | 8/1899 | McCrae . | |
| 652,891 | 7/1900 | Cochran . | |
| 718,629 | 1/1903 | Hunt . | |
| 755,009 | 3/1904 | Igel . | |
| 975,430 | 11/1910 | Humma . | |
| 996,340 | 6/1911 | Hopkins . | |
| 2,493,705 | 1/1950 | Vogel | 224/915 |
| 2,812,123 | 11/1957 | Girton | 224/150 |
| 2,830,747 | 4/1958 | Creste | 224/150 |
| 2,926,826 | 3/1960 | Conrad . | |
| 3,258,182 | 6/1966 | McDonald . | |
| 3,263,806 | 8/1966 | Ring . | |
| 3,275,205 | 9/1966 | Howd et al. . | |
| 3,279,663 | 10/1966 | Torres | 224/915 |
| 3,334,794 | 8/1967 | Saari et al. | 224/150 |
| 4,020,985 | 5/1977 | Halterman . | |
| 4,085,872 | 4/1978 | Foo . | |
| 4,260,088 | 4/1981 | Buckner . | |
| 4,261,494 | 4/1981 | Thomas | 224/915 |
| 4,562,945 | 1/1986 | Erlandson . | |
| 4,760,944 | 8/1988 | Hughes | 224/150 |
| 4,773,577 | 9/1988 | Mikula . | |
| 4,907,614 | 3/1990 | Stamm . | |
| 4,911,347 | 3/1990 | White . | |
| 4,984,724 | 1/1991 | Johnston . | |
| 5,025,819 | 6/1991 | Taylor | 224/915 |
| 5,044,538 | 9/1991 | Bader . | |
| 5,056,819 | 10/1991 | Hayes . | |

FOREIGN PATENT DOCUMENTS

| | | | |
|---|---|---|---|
| 432359 | 3/1948 | Italy | 224/257 |

*Primary Examiner*—Linda J. Sholl
*Attorney, Agent, or Firm*—Milde, Hoffberg & Macklin, LLP

[57] ABSTRACT

A carrying device for a closed umbrella permits the umbrella to be carried over the shoulder or across the body. The carrying device comprises a length of flexible material with an aperture at each end, one aperture fitting over one end of the umbrella and the other over the other end.

5 Claims, 8 Drawing Sheets

CARRYING DEVICE FOR A CLOSED UMBRELLA AND METHOD OF USING SUCH DEVICE

CROSS REFERENCE TO RELATED APPLICATION

This application is a continuation-in-part of U.S. patent application Ser. No. 07/934,289, filed Sep. 24, 1992 now abandoned which, in turn, was a continuation of U.S. patent application Ser. No. 07/718,063, filed Jun. 20, 1991 now abandoned.

BACKGROUND OF THE INVENTION

The invention concerns a carrying device for a closed umbrella and a method for using such a carrying device. More particularly, the invention concerns a flexible strap or strip of material which can be easily attached at both ends of the umbrella and used as a sling to carry the umbrella over the shoulder.

Many people carry a closed umbrella around with them in one hand when rain is likely. Carrying an umbrella in this way, however, makes it impossible to use the hand for other purposes and may even be dangerous if the person carrying it loses his balance and needs to suddenly grab onto a support. It is therefore desirable to provide a device which permits an umbrella to be carried "hands free" and to provide a method of employing the device that will allow the umbrella to be brought along without encumbering the user.

Many devices of this type are known. Some involve a loop attached to a handle which can be slipped over the carrier's wrist, allowing the umbrella to dangle from it.

Such a device is disclosed in the U.S. Pat. No. 2,493,705 to Vogel. However, although such a device does free the carrier's hand, still weighs it down and is therefore less than fully satisfactory.

Other devices comprise means for securing the umbrella to another object being carried by the person or securing the umbrella to the person's clothes. See for example, the U.S. Pat. No. 652,891 to Cochran. Although this approach does to some extent consolidate the various burdens and completely frees the hands, it is cumbersome and often requires special means of attachment mounted on the umbrella being carried.

Also known are lengths of flexible material that extend approximately from the handle to the ferrule (tip) of an umbrella and allow it to be flung over one shoulder or across the back. Such lengths may be permanently attached to the umbrella or to special fasteners on it. U.S. Pat. No. 4,907,614 to Stamm discloses a flexible carrying "handle," each end of which fits into a slotted eye, one in the handle and the other at the ferrule. The U.S. Pat. No. 3,279,663 to Torres discloses an umbrella strap which requires that a metal eye be attached to the handle of the umbrella. The drawback of this solution, however, is that the strap either constitutes a component of the umbrella itself or, because of the special type of fasteners employed, the strap must be purchased together with an umbrella or specifically for a particular type of umbrella.

The U.S. Pat. No. 5,025,819 to Taylor discloses an umbrella manufactured with a built in box containing spring loaded spool that unwinds a strap with a non-adjustable metal loop at the end. Such an arrangement, if designed to be retrofitted to an existing umbrella, will fit only certain types of umbrellas. In addition, Taylor discloses a separate device which is meant to carry a raincoat on an umbrella. This device has non-elastic loops at each end which are used to hang the device onto a closed umbrella by placing one closed aperture over a projecting spine or rib member that supports the canopy of the umbrella and the other over the umbrella ferrule.

Various arrangements are known for attaching a strap to a handle. For example, the U.S. Pat. No. 4,085,872 to Foo discloses an elastic loop for a tennis racket handle and the U.S. Pat. No. 3,334,794 discloses a slip loop for a gun stock. None of these disclosures address the problem of providing a slip free grip at both ends of an umbrella.

SUMMARY OF THE INVENTION

A principal object of the present invention accordingly is to provide a device for conveniently carrying a closed umbrella.

Another principal object of the invention is to provide a carrying device for an umbrella which may be easily attached to both ends of the umbrella and requires no prior modification or special design of the umbrella.

Another principal object of the invention is to provide a carrying device for an umbrella which may be used with any type, style or size of umbrella.

A further principal object of the present invention is to provide a carrying device for an umbrella which can be used with either end attached to either end of an umbrella.

These objects, as well as other objects which will become apparent in the discussion that follows, are achieved, in accordance with the invention, in a device of the aforesaid type comprising a length of flexible material with identical, closed self-adjusting elastic apertures or "cuffs" at each end, one cuff fitting over one end of the umbrella and the other over the other end. Each cuff of the device is formed of a permanently closed loop of flexible, elastic material of such dimension, prior to stretching, as to grip tightly a respective end of the umbrella. Because the cuffs are stretchable, they are adapted without manual adjustment to fit over both the top and the bottom ends of the umbrella.

A device of this type will completely free the user's hands of the encumbrance and weight of the umbrella being carried. The main advantage over the prior art is that, since the apertures (cuffs) at each end of the length of material can fit over ends of umbrellas of different size and shape, the umbrella needs no special type of fastener and does not have to be sold with the hand-freeing device permanently attached to it.

The length of material can be any flexible material, woven or non-woven, such as fiber, leather, plastic, chain, or thin metal strip. It may be woven or braided. The material may be flat, round or polygonal in cross-section. It may be elastic, if desired, in either its entire length or portions of its length.

If the material is elastic over a substantial portion of its length, it can be shorter than the umbrella to be carried. This feature will help to secure the device to the umbrella.

The length of material, however, can also be longer than the umbrella. In this event it need not be elastic and will for practical purposes be approximately 1½ times as long as the umbrella to be carried. The length can be made adjustable, with a belt-type buckle attachment for example, to fit different sizes, types and styles of umbrellas, and to fit the user.

The cuffs at each end of the length of material may be loops created by securing the free end of the material back against its outer length, or separate structures attached to each end of the material. The cuffs at both ends of the material are made elastic to ensure a tight, secure grip on the umbrella.

Another principal object of the invention is a method of using the aforesaid device. This object is attained in accordance with the invention by positioning one of the cuffs over one end of the umbrella and the other over the other end and looping the umbrella, with the attached carrying device, through an arm and shoulder, such that the umbrella is carried either bottom end up or down, either over the shoulder or across the body from shoulder to opposite hip.

When not being employed, the length of material can be rolled up and conveniently carried in a pocket or purse or attached to the umbrella handle by both cuffs.

The preferred embodiments of the present invention will now be described with reference to the accompanying drawings.

DESCRIPTION OF THE PREFERRED EMBODIMENTS

Figure 1A:
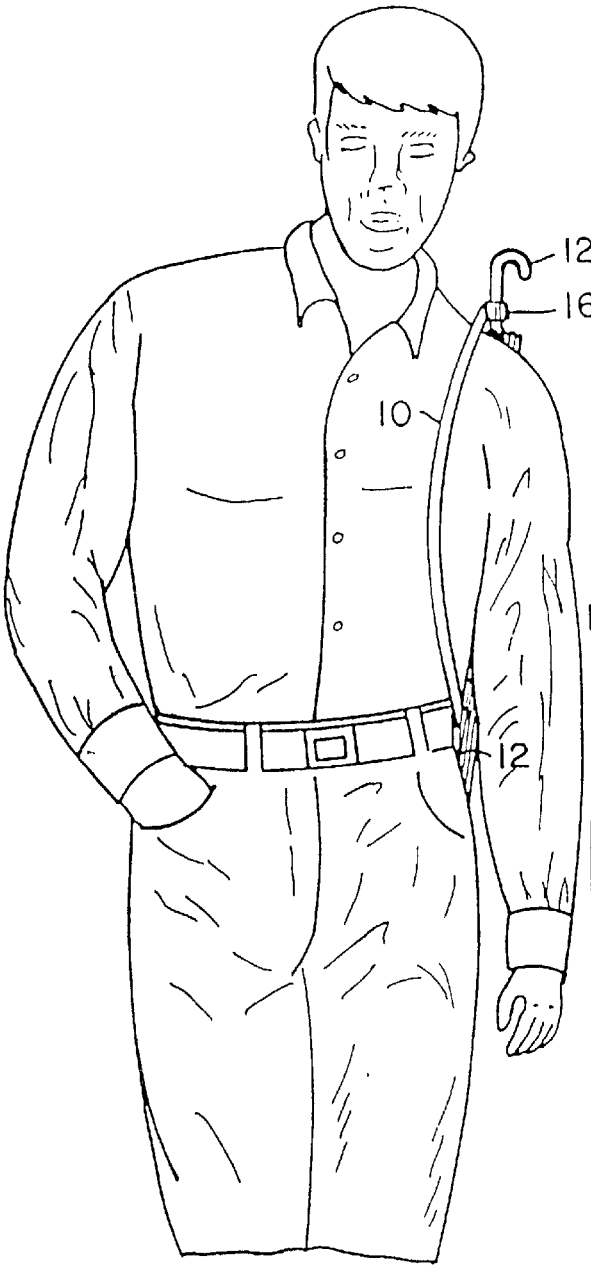
FIG. 1A is an approximately frontal and FIG. 1B a dorsal-to-lateral view of an individual using an umbrella carrying device in accordance with the invention to carry a closed umbrella with his hands free.

The preferred embodiments of the present invention will now be described with reference to FIGS. 1–10 of the drawings. Identical elements in the various figures are designated with the same reference numerals.

Figure 1B:
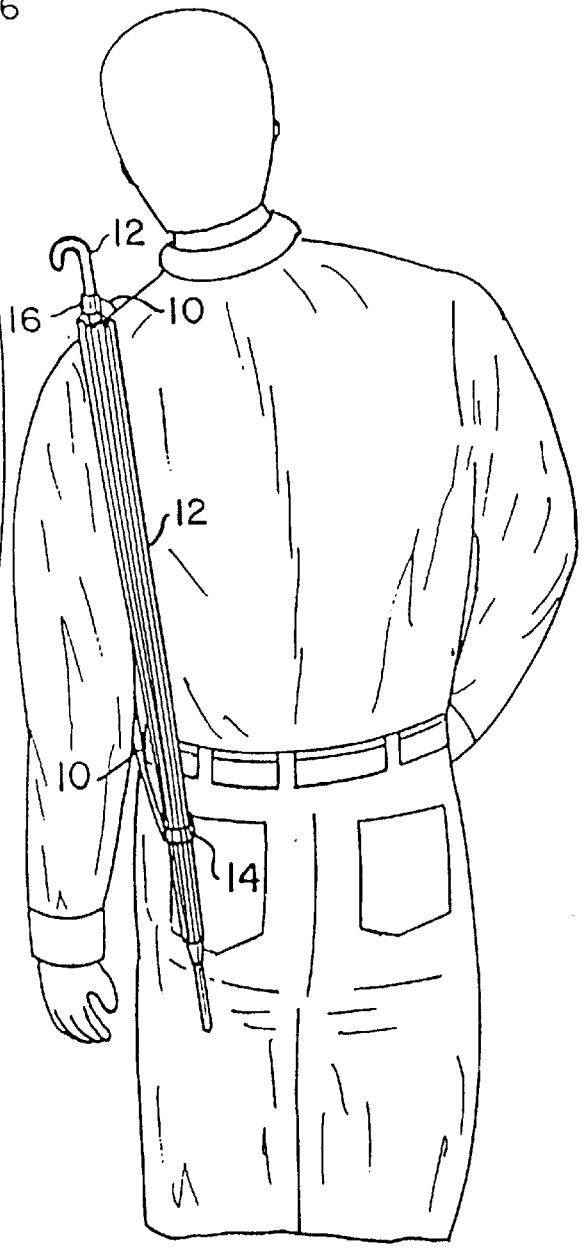
FIG. 1C is an approximately frontal view of an individual using an umbrella carrying device in accordance with the invention to carry a closed umbrella upside down, diagonally across the person's back.

Referring to FIGS. 1A, 1B and 1C, there is shown a strap formed of a length 10 of material having an aperture or "cuff" 14 and 16 at each end. Cuff 16 fits over one end (e.g., the upper, handle end) of a folded-up umbrella 12, and aperture 14 fits over the umbrella's lower, tip end, the ferrule in this present case. The strap permits the umbrella to be carried over the shoulder, as shown in FIGS. 1A and 1B, or across the back of the user as shown in FIG. 1C.

Figure 2A:
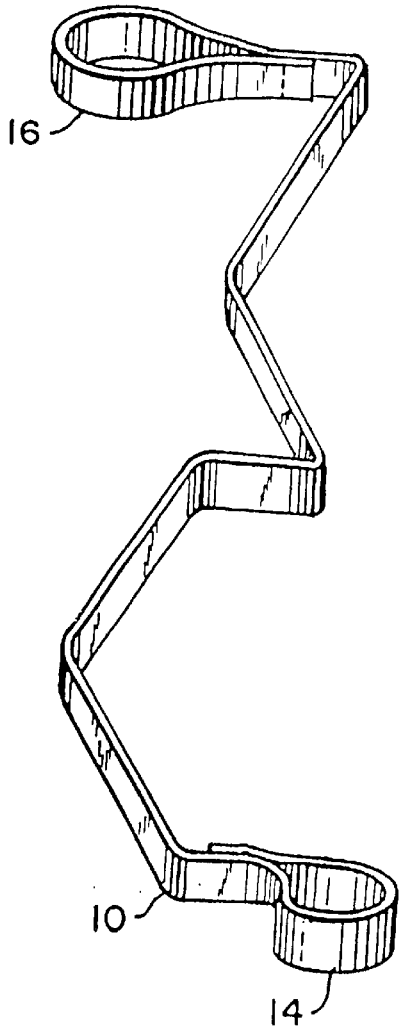
FIG. 2A is a perspective view of one preferred embodiment of the invention comprising a length of material in the form of a strap with loops of the same material at each end.
Figure 2B:
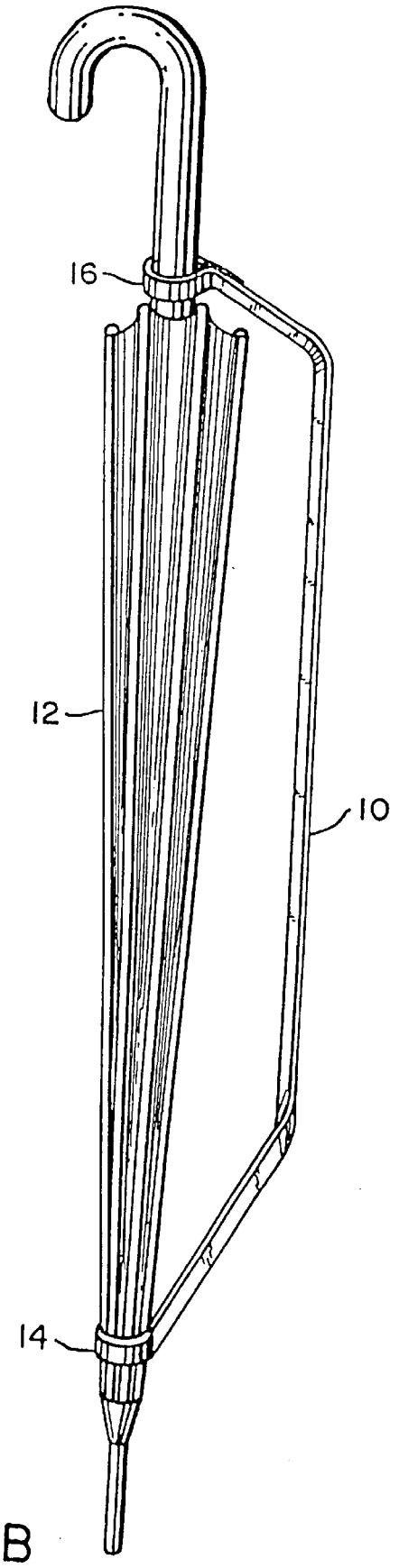
FIG. 2B is a perspective view showing the strap illustrated in FIG. 2A mounted on an umbrella.

The length of material illustrated in FIGS. 2A and 2B is a strap of leather, plastic, or fabric with its ends turned back and secured, sewn for example, to create apertures in the form of loops.

Figure 3A:
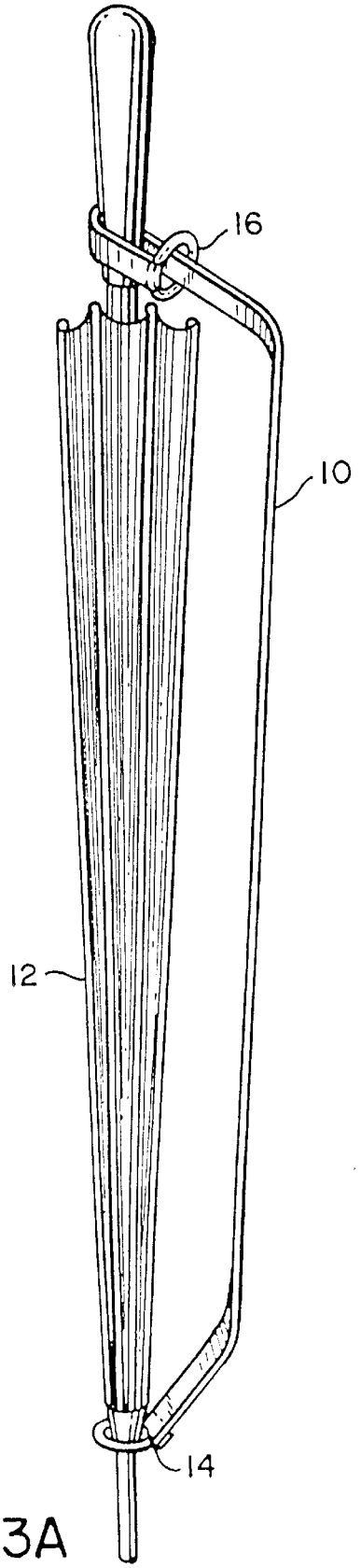
FIG. 3A is a perspective view of a preferred embodiment of the invention in the form of a strap with a noose at the top and a rigid ring at the bottom.
Figure 3B:
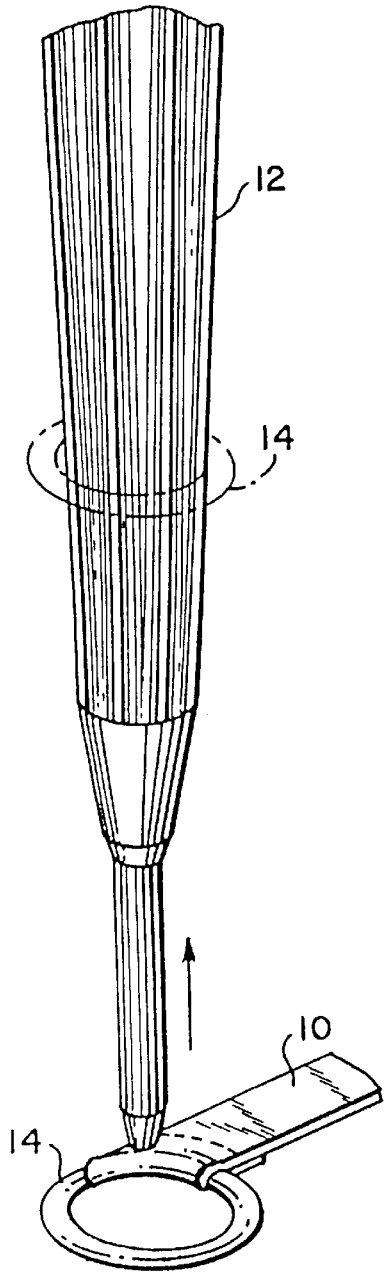
FIG. 3B is a close-up view of the rigid ring at the bottom.

The carrying device illustrated in FIGS. 3A and 3B is a strap 10 with apertures 14 and 16 in the form of rigid rings secured, sewn for example, to each end. The ring at the top rides along over the material to create a noose that fits over the upper end of the umbrella 12 being carried, again an umbrella. The bottom ring fits snugly, but not necessarily tightly, over the lower end of the umbrella.

Figure 4A:
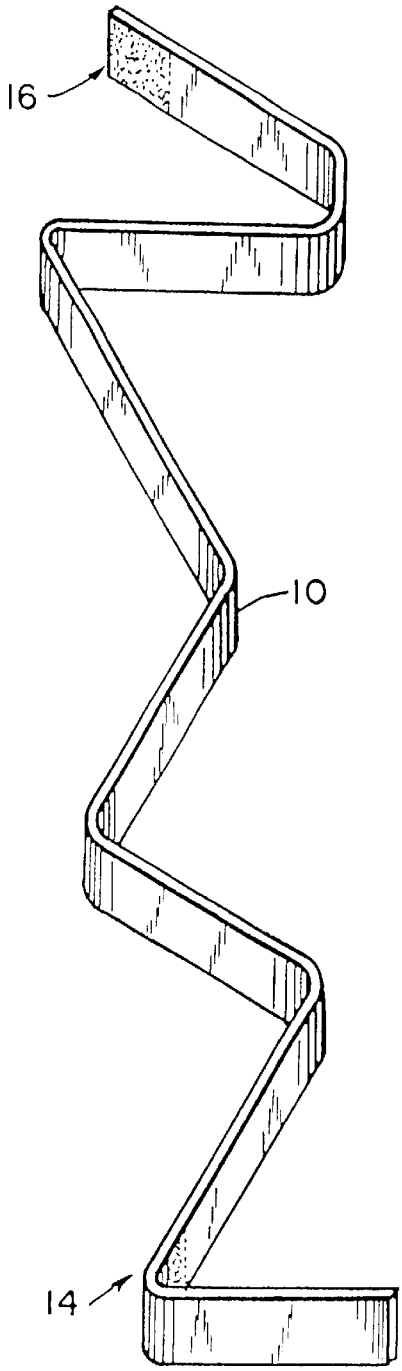
FIG. 4A is a perspective view of a preferred embodiment of the invention in the form of as strap with sections of Velcro at each end.
Figure 4B:
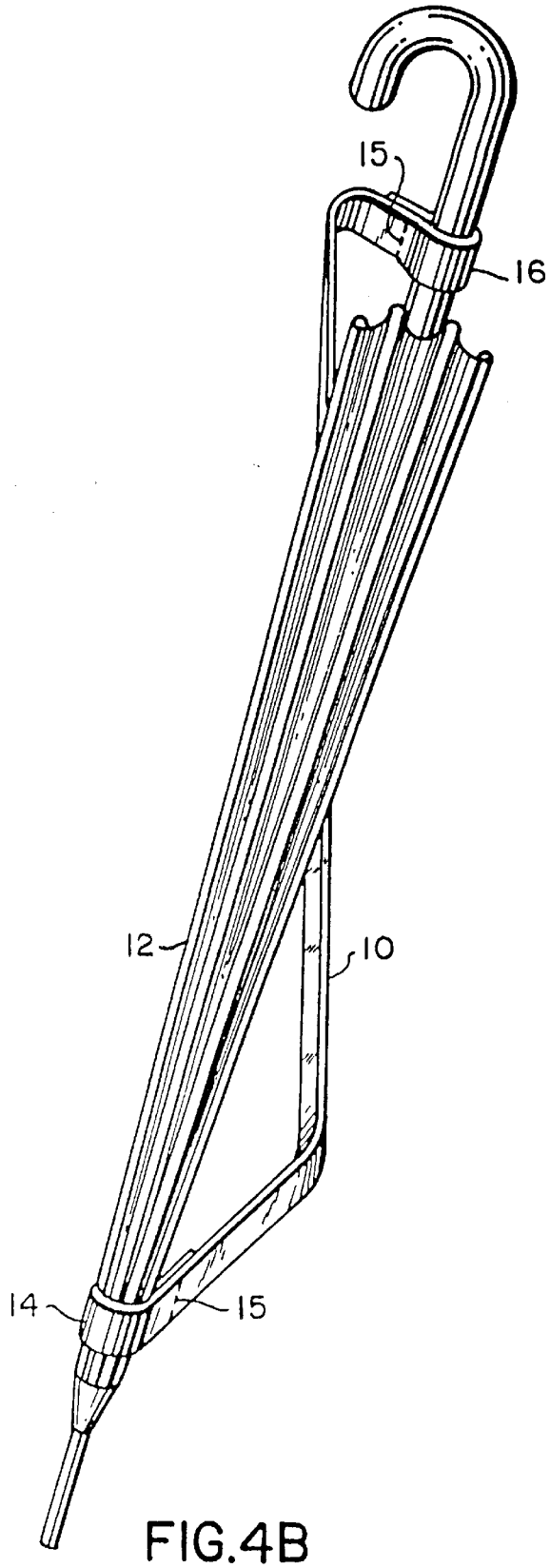
FIG. 4B shows the strap of FIG. 4A attached to an umbrella.

The carrying device illustrated in FIG. 4A is a strap 10 having sections of Velcro at each end that make it possible to create apertures 14 and 16 in the form of loops of any convenient size to match the cross-section of the umbrella being carried. FIG. 4B shows the strap of FIG. 4A attached to an umbrella 12. Alternatively, the strap may simply be sewn, along the dashed lines 15, to form permanent apertures of a prescribed size.

Figure 5:
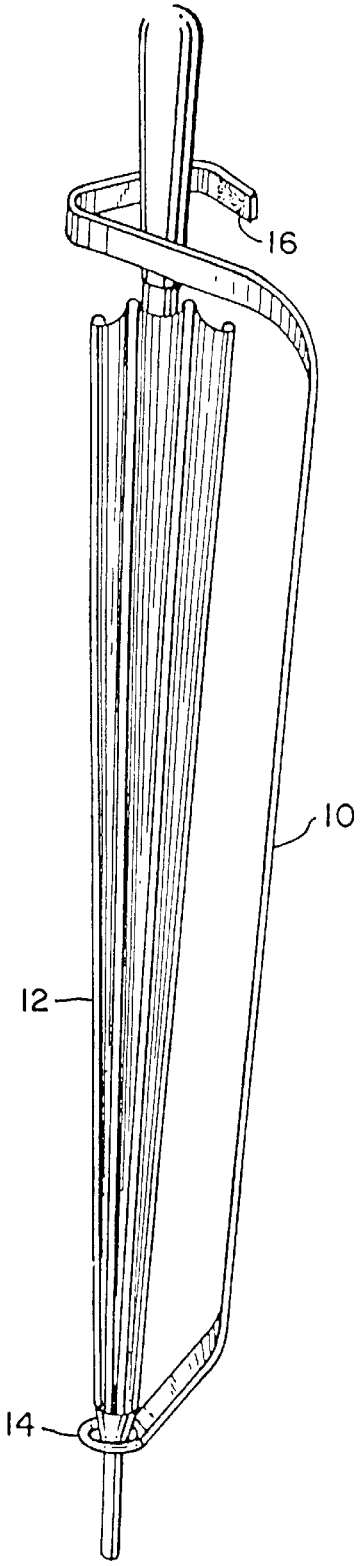
FIG. 5 is a perspective view of a preferred embodiment of the invention in the form of a strap with a section of Velcro at the top and a rigid ring at the bottom.

The carrying device illustrated in FIG. 5 is a strap 10 having a section of Velcro at the top, permitting formation of a loop 16, and a rigid ring 14 at the bottom.

Figure 6:
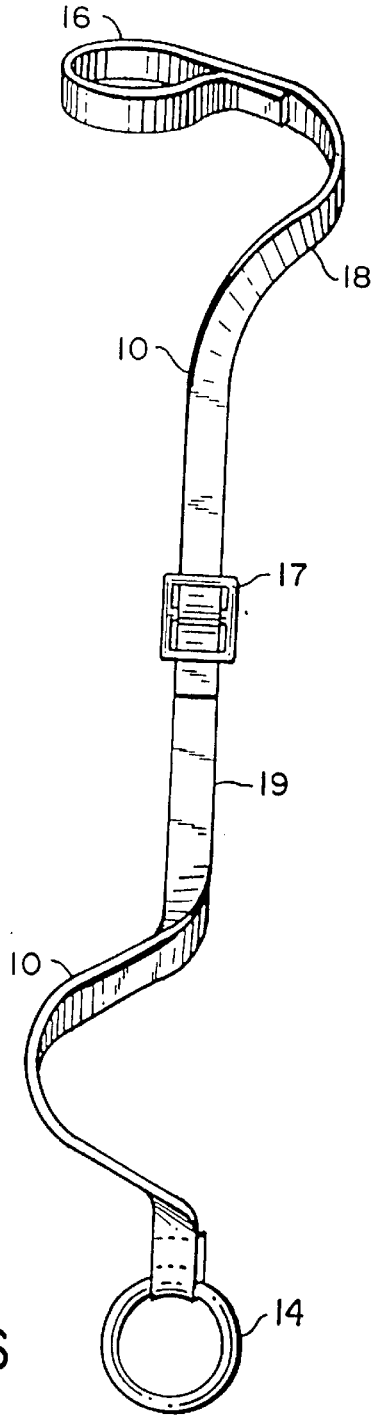
FIG. 6 is a perspective view of a preferred embodiment of the invention in the form of an adjustable strap.

The carrying device 10 illustrated in FIG. 6 is in two parts, 18 and 19, secured together by an ordinary buckle 17, to make the length adjustable.

Figure 7:
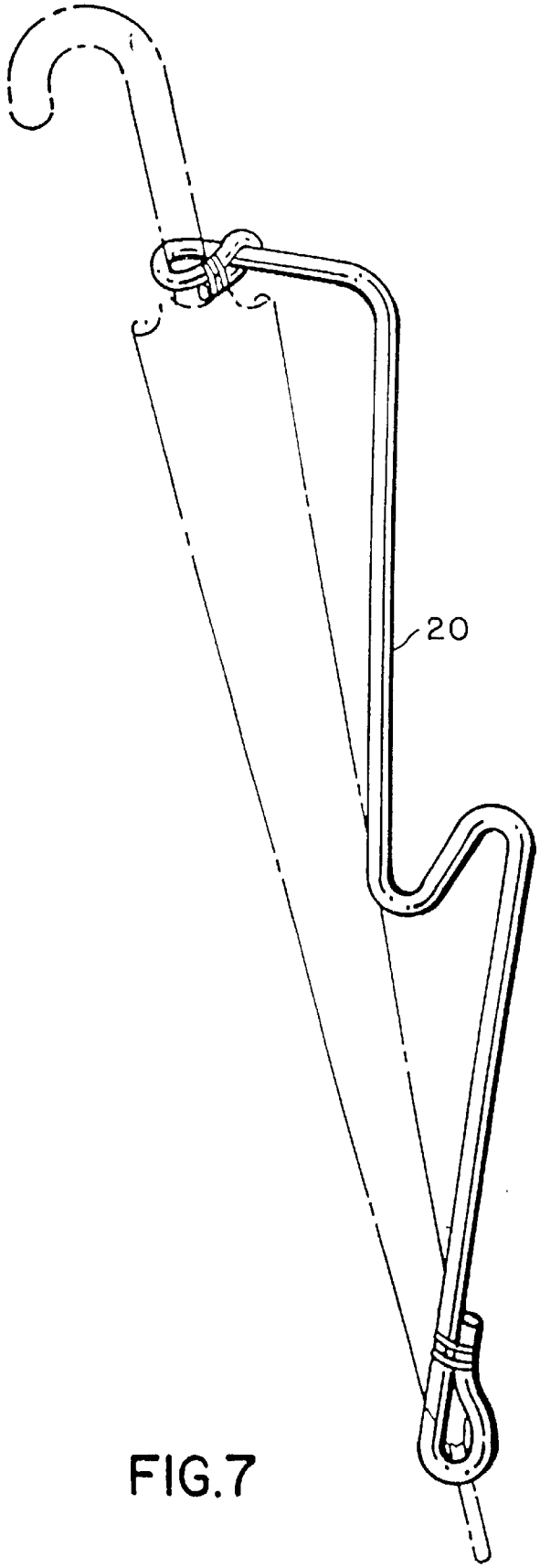
FIG. 7 is a perspective view of a preferred embodiment of the invention comprising a length of material made from bungee.

The carrying device 10 illustrated in FIG. 7 is a rope 20 having a noose 14 at the top and a fixed loop 16 at the bottom.

Figure 8:
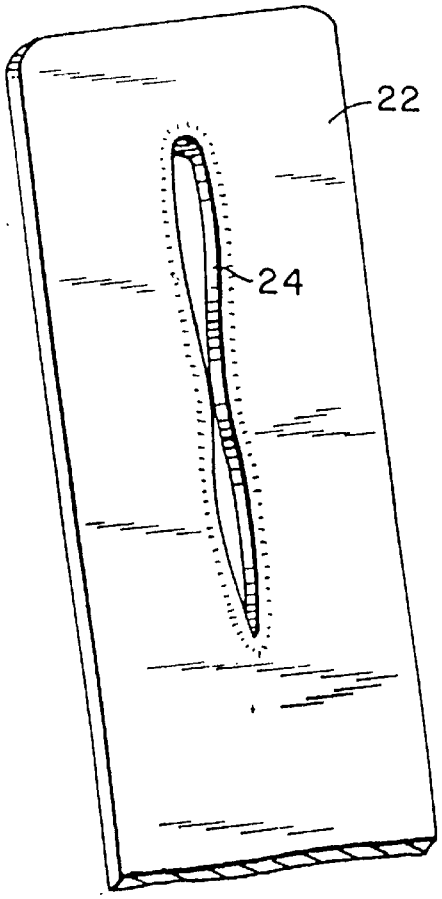
FIG. 8 is a perspective view of a preferred embodiment of the invention showing the end of a flexible strap with a buttonhole aperture at top and bottom of a strap like material.

FIG. 8 shows one end of a carrying strap 22 in actual size. The strap is provided with buttonholes 24 about 2½ inches in length at both ends of the strap. The strap material is preferably non-elastic, and may be canvas or leather, for example. The opposite end of the strap may be identical, or may be provided with another type of aperture.

Figure 9A:
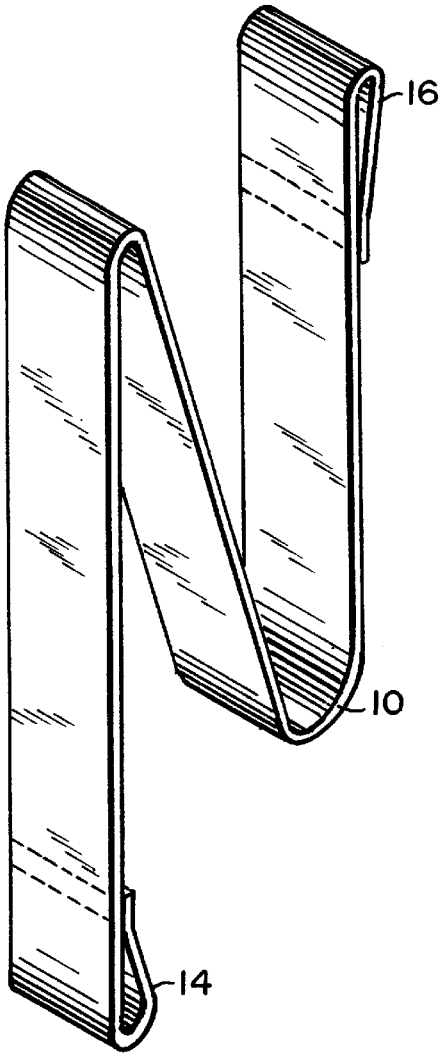
FIG. 9A is a perspective view of a preferred embodiment of the invention, very similar to the embodiment of FIG. 2A, comprising a length of material in the form of a strap with loops of the same material at each end.
Figure 9B:
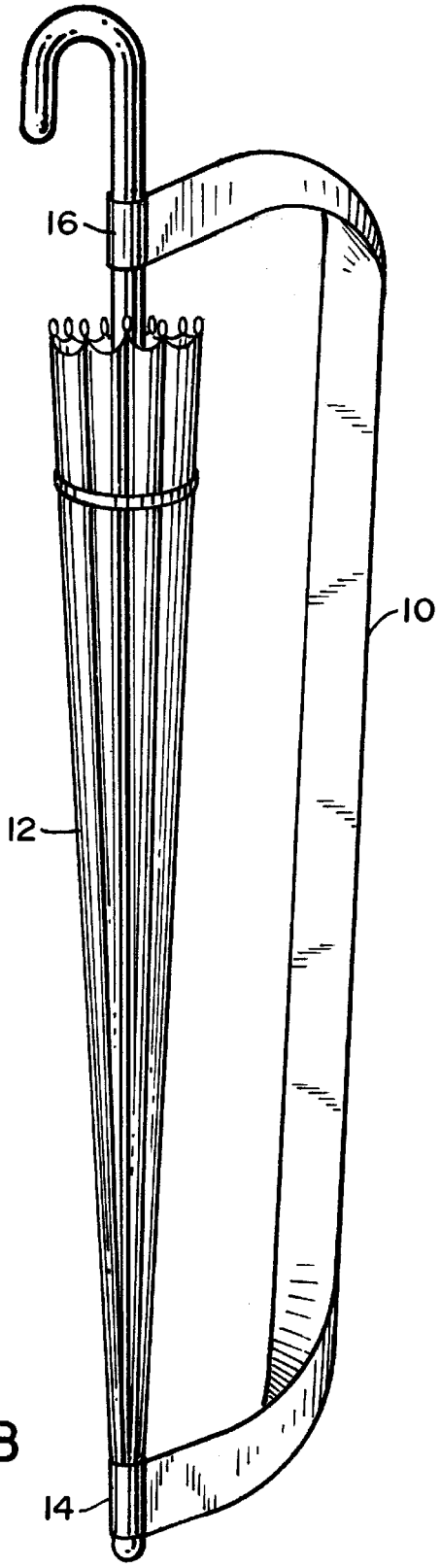
FIG. 9B is a perspective view showing the strap illustrated in FIG. 9A mounted on an umbrella.

FIG. 9A shows a carrying device made from a single strap of flexible and elastic material. Both ends of the strap are folded over and sewn in an identical manner to form identical apertures or cuffs 14 and 16. As shown in FIG. 9B, the cuffs 14 and 16 are attachable to opposite ends of a closed umbrella 12. Because the cuffs 14 and 16 are identical, they may be connected to either end of the umbrella.

The elastic material of the cuffs is of such dimension that it grips tightly around a respective end of the umbrella 12 prior to stretching. The loops are thus "self-adjusting" and will fit any size, style or shape of umbrella and will fit over either end of the umbrella.

The carrying device is thus "universal" in the sense that either end of the strap can be attached to either end of an umbrella and in that the device will fit any type of umbrella.

Figure 10:
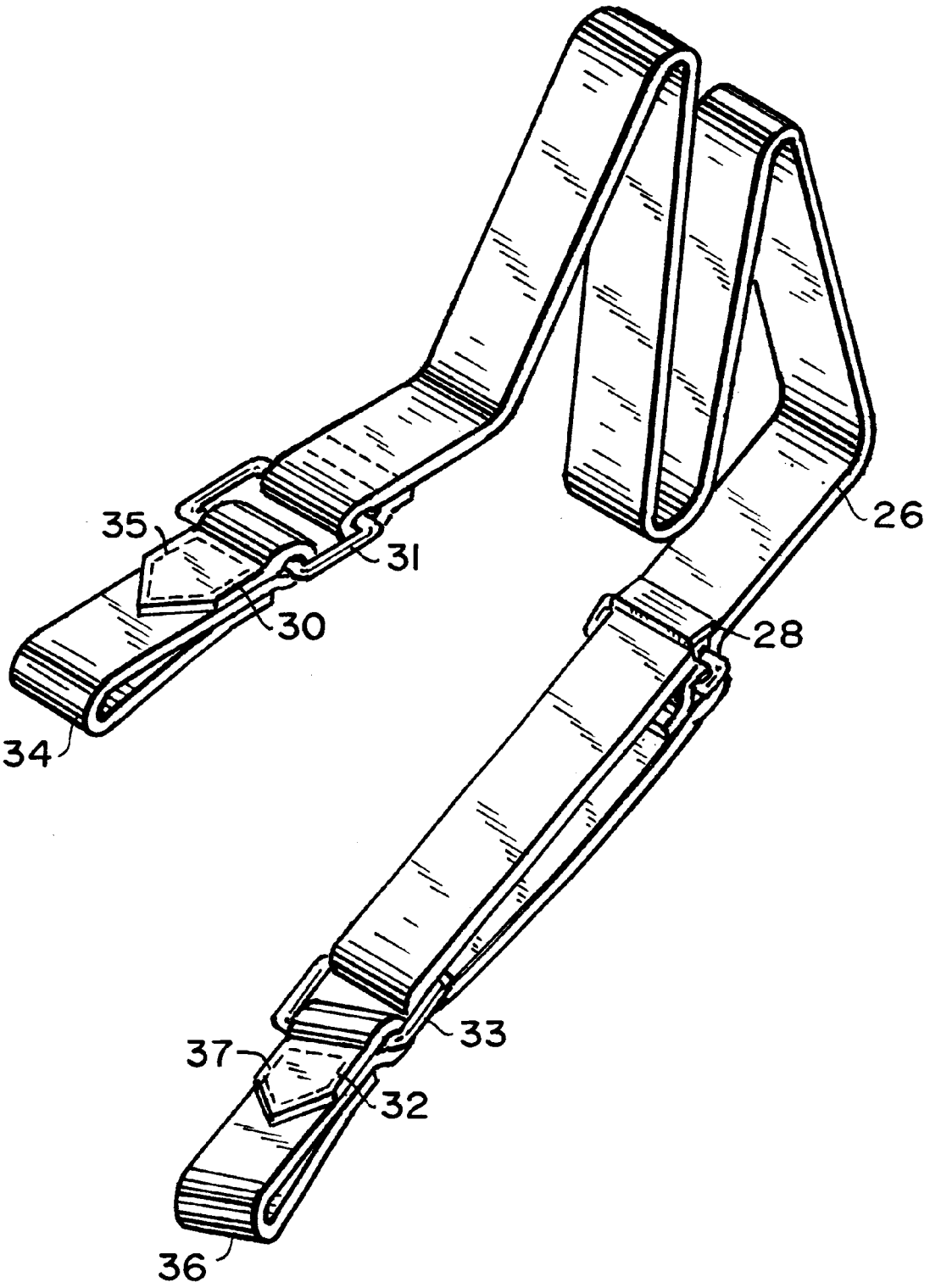
FIG. 10 is a perspective view of still another preferred embodiment of the present invention comprising an adjustable strap with identical cuffs attached at each end.

FIG. 10 shows still another embodiment of the carrying device according to the present invention. In this embodiment a strap 26 of flexible, but not elastic material is looped back upon itself and made adjustable by means of a belt clamp 28. Identical cuffs 34 and 36 made of flexible, elastic material are reinforced by leather strips 30 and 32, respectively. The strips 30 and 32 are attached to the elastic loops 34 and 36 by stitching 35 and 37, respectively. The leather strips 30 and 32 are attached to the ends of the strap 26 by means of fittings 31 and 33, respectively.

In conclusion, in the best mode of practicing the present invention, a universal umbrella carrying device is provided for carrying any closed umbrella, either over the shoulder or diagonally over the body from shoulder to hip. The carrying device comprises length of flexible material with identical, closed, self-adjusting elastic cuffs at each of its two opposite ends. Each cuff is formed of a permanently closed loop of flexible, elastic material of such dimension, prior to stretching, as to grip tightly a respective end of the umbrella. Because the cuffs are stretchable, they are adapted without manual adjustment to fit over both the top and the bottom ends of the umbrella.

The carrying strap is used by inserting either the top or the bottom end of an umbrella into one of the cuffs of the carrying device and inserting the remaining end of the umbrella into the other one of the cuffs of the carrying device. Thereafter, the user loops the umbrella with the attached carrying device through an arm and shoulder, such that the umbrella is carried either bottom end up or down, either over the shoulder or diagonally across the body from shoulder to opposite hip.

In one embodiment, the entire length of material of the carrying device is elastic. In this case, the length of flexible material may be formed of the same elastic material as the cuffs.

Alternatively, a portion of the length of material may be made substantially inelastic (provided that the cuffs remain elastic). In this case, the length of material is preferably made adjustable.

There has thus been shown and described a novel carrying device for a closed umbrella and method of using such device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method of using a universal umbrella carrying device for carrying any closed umbrella either over the shoulder or diagonally over the body from shoulder to hip, said umbrella having a top end with a handle thereon and having an opposite bottom end, said carrying device comprising a length of flexible material with identical, closed, self-adjusting elastic cuffs at each of its two opposite ends, each cuff being formed of a permanently closed loop of flexible, elastic material of such dimension, prior to stretching, as to grip tightly a respective end of said umbrella, said cuffs being stretchable and thereby adapted without manual adjustment to fit snugly over both the top and bottom ends of said umbrella, and to maintain their position, without falling off, until removed by the user, said method comprising the steps of:

(a) inserting either the top or the bottom end of said umbrella into one of said cuffs of said carrying device;

(b) inserting the remaining end of said umbrella into the other one of said cuffs of said carrying device; and (c) looping said umbrella with said attached carrying device through an arm and shoulder, such that said umbrella is carried either bottom end up or down, either over the shoulder, or diagonally across the body from shoulder to opposite hip.

2. The method defined in claim 1, wherein the entire length of said flexible material is elastic.

3. The method defined in claim 1, wherein a portion of the length of said flexible material is substantially inelastic.

4. The method defined in claim 3, wherein the length of said flexible material is adjustable.

5. The method defined in claim 2, wherein the length of said flexible material is formed of the same elastic material as said cuffs.

* * * * *